United States Patent [19]

Krasik

[11] Patent Number: 4,865,308

[45] Date of Patent: Sep. 12, 1989

[54] LOW COST COLLATING METHOD

[76] Inventor: Michael H. Krasik, 1849 N. 53rd St., Seattle, Wash. 98103

[21] Appl. No.: 154,947

[22] Filed: Feb. 10, 1988

[51] Int. Cl.[4] ..... B65H 31/04

[52] U.S. Cl. ..... 271/213; 414/791.2; 270/58

[58] Field of Search ..... 271/213, 180, 177, 207; 270/58; 414/54, 97

[56] References Cited

U.S. PATENT DOCUMENTS

| | | | |
|---|---|---|---|
| 3,172,548 | 3/1965 | Mestre . | |
| 3,964,741 | 6/1976 | Kroeker | 271/213 |
| 4,157,059 | 6/1979 | Schultes et al. . | |
| 4,208,122 | 6/1980 | Iwamoto et al. | 355/14 R |
| 4,293,214 | 10/1981 | George et al. | 355/14 R |
| 4,616,821 | 10/1986 | Boeve et al. | 271/213 |

*Primary Examiner*—Joseph J. Rolla
*Assistant Examiner*—Stephen B. Parker
*Attorney, Agent, or Firm*—Seed and Berry

[57] ABSTRACT

A low cost collating method includes a tray assembly supported and positioned to receive pages exiting from a page-producing apparatus in a first direction. The tray assembly is movable in a direction perpendicular to the first direction and is moved incrementally between deliveries of pages of a document being produced. As a result, the document pages are interleaved, collated and therefore readily separable. A detent mechanism assists with consistent, proper positioning of the tray assembly. In one embodiment, a tray is removable from the tray assembly for temporary storage of the pages while other trays are used for collating. Indentations and associated markings simplify the grasping and holding involved in separating the collated pages.

3 Claims, 2 Drawing Sheets

FIG.1
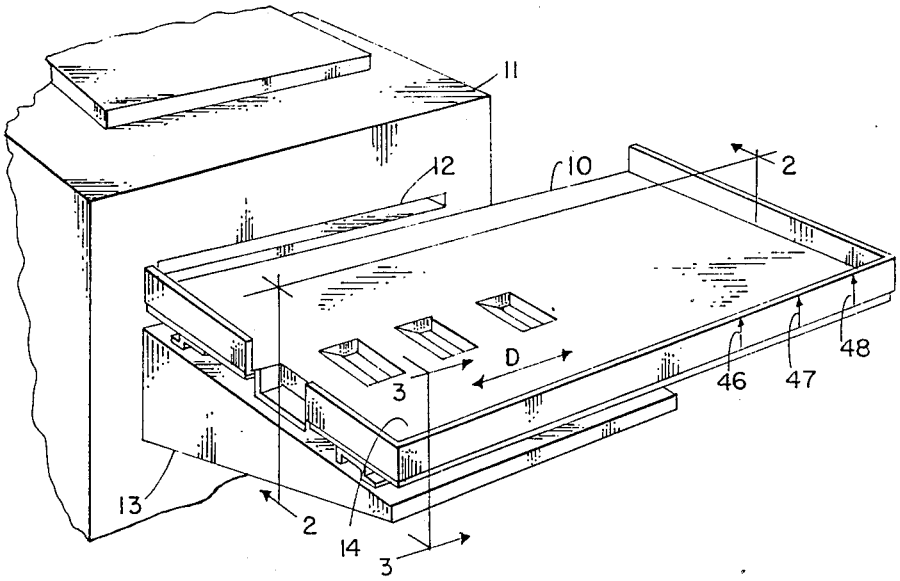
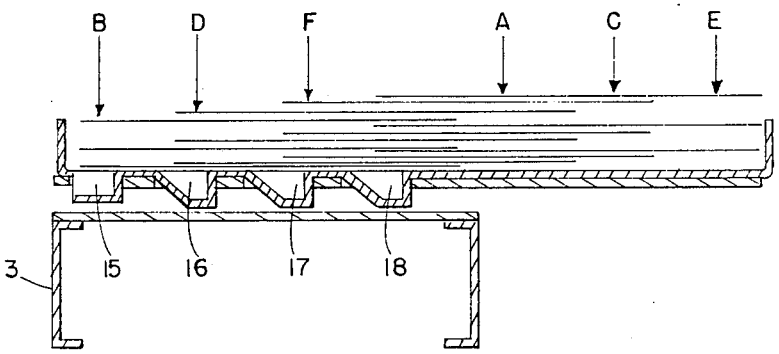
FIG.2

FIG. 3
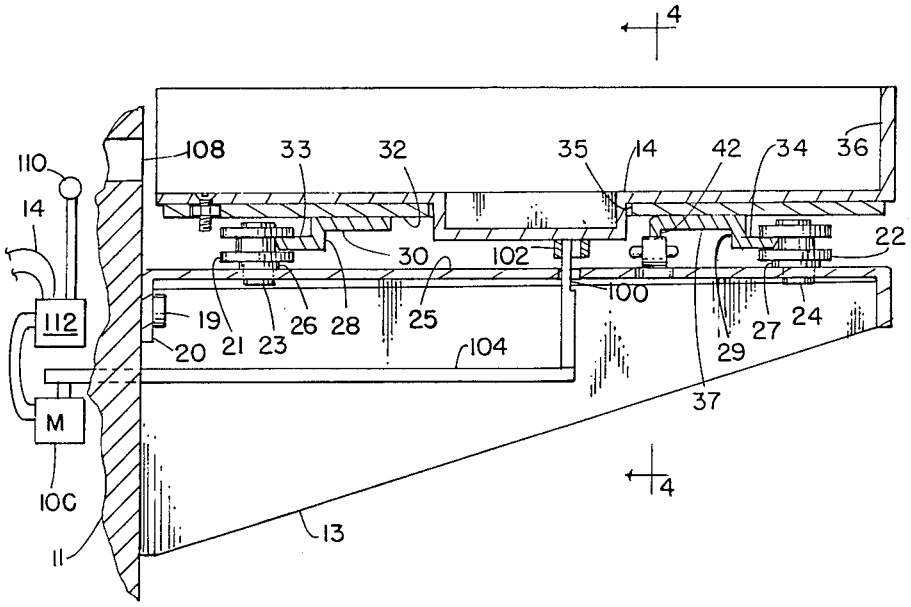
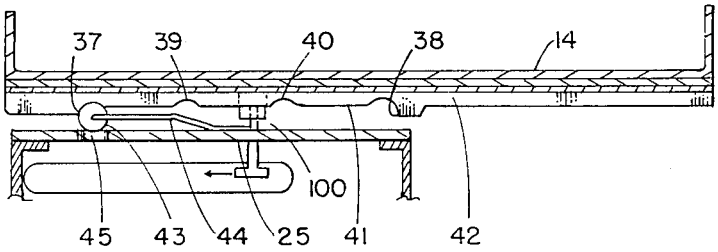
FIG. 4

LOW COST COLLATING METHOD

TECHNICAL FIELD

The subject invention is in the field of apparatus for sheet feeding and handling, more specifically, the handling of sheets ejected by printing and reproduction machines to put the sheets in a specific order or to facilitate putting the sheets in order. Still more specifically, it is in the field of such machines which are simple, inexpensive and adaptable to a wide variety of reproduction apparatus.

BACKGROUND ART

The prior art in this field is profuse. The following U.S. patents constitute prior art related to relatively simple sheet handling apparatus provided to collate or assist in collating sheets emanating from printing and reproduction (copying) machines.

| | |
|---|---|
| 3,172,548 | 4,208,122 |
| 3,964,741 | 4,293,214 |
| 4,157,059 | |

None of the devices disclosed in these patents actually collate multipage documents. Instead, these devices either offset two or more sets of copies having identical pages to facilitate separation thereof for further high-speed collation or operate on already collated copy sets.

Therefore the need for simple apparatus for collating multipage copies remains unmet and the primary objective of the subject invention is to meet that need.

SUMMARY OF THE INVENTION

The invention is a collating method and receiving tray assembly for the pages produced by apparatus for printing or reproducing pages one at a time. The pages exit from the apparatus moving in a first direction. The tray assembly is movable in a horizontal direction essentially perpendicular to the first direction. The tray assembly is moved manually by the machine operator or automatically, and its motion is detented so that it can be readily moved to and stopped at each of a series of positions.

When the apparatus is in use, the pages of a document being copied are produced and the tray assembly is moved so that one page is deposited at a separate, overlapping position in series. This procedure is repeated for each page of the document, starting with the last page and ending with the first. The result is that a number of properly collated copies of the document are deposited on the tray assembly. That is, the incremental tray assembly motion is less than the width of the pages. The pages will therefore be interleaved but readily separable. Each copy is sufficiently displaced from the adjoining one to permit separation of each copy from the others when they are picked up from the tray on the assembly.

The tray incorporates indentations which provide space for the fingers used to pick up each set of pages and indications of the points at which to restrain the sets not being picked up when each set is picked up.

In the preferred embodiment, the tray is detachably mounted on a carriage so that the tray may be removed and used for temporary storage. The tray may thus be removed to a more convenient location for copy handling and/or better utilization of the page-producing apparatus (copier) because the copier can be used with other trays while filled trays are being used for storage and/or emptied.

The mechanical embodiments of the invention are varied in detail to suit the various commercially available printing and copying machines to which the invention is and/or will be adaptable. The mechanical designs are within the capabilities of persons of ordinary skill in the art. More fully mechanized embodiments are also within the capability of people having ordinary skills in the art, such as embodiments in which the tray is moved automatically instead of manually. The embodiments are described in detail below with reference to the attached drawings.

The apparatus of the invention comprises collating apparatus used in conjunction with apparatus for producing pages and delivering them in sequence through an exit slot onto a tray of the collating apparatus, the tray having n receiving positions for pages and being movable so that the receiving positions accumulate up to n sets of N pages. This apparatus embodies a collating method comprising the steps of:

(a) positioning the tray so that a first receiving position will receive a page exiting the exit slot;

(b) producing an initial page of the set of pages;

(c) delivering an initial page into the first position;

(d) moving the tray so that a receiving position adjacent to the position which just received a page will receive the next page exiting the exit slot;

(e) producing a second initial page of the set of pages;

(f) delivering the second initial page into the receiving position positioned to receive it;

(g) repeating steps d, e and f n-2 times to deliver n initial pages into n receiving positions;

(h) repeating steps a through g N-1 times to deliver n sets having N pages into n receiving positions.

BRIEF DESCRIPTION OF THE DRAWINGS

FIG. 1 is a schematic perspective view of a first embodiment of the subject collator attached to a copier.

FIG. 2 is a sectional view taken at 2—2 in FIG. 1 and schematically illustrates the interleaving of collated copies.

FIG. 3 is a sectional view at 3—3 in FIG. 1 showing details of the collator, including an automated version of the invention, and specifically the mounting of the carriage.

FIG. 4 is a sectional view taken at 4—4 in FIG. 3 showing further details of the collator, specifically the detent apparatus.

DETAILED DESCRIPTION OF THE INVENTION

A first embodiment of the subject collator 10 (shown in FIG. 1), attached to copier 11 near copy outlet 12, comprises a base 13 and tray 14. The tray is attached to the base by means allowing the tray to be moved in the directions indicated by arrow D. Detent means is provided, facilitating moving the tray in incremental distances past the outlet. The number of incremental distances determines the maximum number of sets of page copies the collator will accommodate in one operation. For example, to have four sets, the tray must be movable three incremental distances to provide four reception positions for the copies. To continue the example, to produce and collate four copies of a document (i.e., four sets of the pages of the document), the procedure is as follows:

1. The copier is caused to produce four copies in sequence, preferably starting with the last page.

2. The first copy of the first page reproduced is deposited in the tray in the first reception position, with the tray in the position shown.

3. The tray is moved a first incremental distance and the second copy is then deposited in the tray in the second reception position.

4. The tray is then moved a second incremental distance and the third copy is then deposited in the tray in the third copy reception position.

5. The tray is then moved a third incremental distance and the fourth copy is then deposited in the tray in the fourth copy reception position.

6. The tray is then returned to its starting position, the second from last page is inserted in the copier, the copier is caused to produce four copies of the second from last page, and the second from last pages are accommodated by and located in the tray similar to the last pages.

7. The process is repeated until all the pages have been copied.

At this point, there will be four sets of the document pages in the tray, collated and with the pages interleaved as shown in FIG. 2, a sectional view of the tray taken at 2—2 in FIG. 1. To separate the sets of pages, the operator presses on the stack of pages at a point just beyond the edges of the first set, point A in the figure, grasps the exposed edges at B and extracts the first set of pages. Indentation 15 facilitates grasping the pages of the first set. The second set of pages is similarly extracted by pressing at C, just beyond the edges of the second set, and grasping the second set at D to extract it, indentation 16 facilitating this grasping. The third set is also similarly extracted, pressing at E and grasping at F, with the grasping facilitated by indentation 17. The fourth set can then be picked up using indentation 18. Additional indentations, adjacent to indentations 15, 16, 17 and 18, may be provided to permit conventional stapler jaws to grasp the copies thereat for stapling prior to removal of the collated copies from the tray 14.

FIG. 3 is a sectional view of the apparatus taken at 3—3 in FIG. 1. The section 3'—3' is identical but not shown. In FIG. 3, base 13 is attached to copier 11 by fastener 19 through flange 20. Grooved rollers 21 and 22 rotate on pins 23 and 24 and are spaced away from top 25 by washers 26 and 27. Rails 28 and 29, attached by spot welding flanges 30 and 31 to carriage 32, extend the full length of the carriage. Flanges 33 and 34 engage a similar set of rollers at sections 3'—3' so that the carriage is stably supported from the base and freely movable in the direction indicated by arrow D in FIG. 1. Tray 14 rests on the carriage and is indexed to it by the protrusion of the indentations into mating holes in the carriage, hole 35 being typical. Side 36 of the tray prevents the copies from sliding off the tray.

FIG. 4 is a sectional view taken at 4—4 in FIG. 3 and illustrates the detent means which facilitate positioning the tray properly for receiving copies deposited from outlet 12 (FIG. 1). Ends 37 and 38 and notches 39 and 40 in cutout 41 in flange 42 engage roller 43 on spring 44 to help position the tray in the four positions needed to accommodate up to four copies of a document being reproduced. Spring 43 is spot welded to top 25, and hole 45 provides clearance for the roller.

Arrows 46, 47 and 48 in FIG. 1 indicate the points at which to press on the stack of copies while sets of pages are being removed. Handle 49 is attached to the carriage at 50 and facilitates manual positioning of the tray.

In alternate embodiments of the invention, the tray is actuated electromechanically. As shown in FIGS. 3 and 4, the actuation apparatus includes a pin 100 rotatably and removably received by tray 14 in socket 102. An arm 104, actuated by a DC stepping motor 106, moves the tray cooperatively with the ejection of copies through exit slot 108. The ejection of copies is sensed by sensor 110. The stepping motor 106 and sensor 110 are cooperatively engaged by a conventional DC controller 112 which is electronically engaged with the copier copy control circuitry (not shown) through wires 114. Actuation apparatus of the nature required is known to be within the capabilities of person having ordinary skills in the art.

It can be understood from this description that the subject invention meets its objectives. The apparatus is simple and provides collation for two or more multipage copies. It is easy to use, economical to manufacture, and adaptable to any apparatus which ejects the pages produced in an essentially horizontal direction. Also, partly because of its simplicity, it can be made as durable as desired.

While a preferred embodiment of the invention has been described herein, it will be apparent to those skilled in the art that other embodiments and modifications of the described embodiment are possible within the scope of the invention, which is limited only by the attached claims.

I claim:

1. An automatic method for collating a desired number of copy sets of a multipage document from a copying machine of the type having a fixed exit slot, comprising the steps of:

(a) placing an original page of the multipage document on the copying machine;

(b) depositing a copied page of the original page in a movable deposit tray located adjacent to the exit slot in a first collating position;

(c) moving the deposit tray horizontally to a subsequent collating position with respect to the exit slot a distance less than a page width;

(d) depositing another copied page of the original page in the deposit tray so as to overlay only a portion of the previously deposited copy;

(e) repeating steps c and d until the number of deposited copies equals the desired number of copy sets;

(f) returning the deposit tray to the first collating position and replacing the original page on the copy machine with another original page; and (g) repeating steps b through f until all pages of the multipage document have been copied, whereby displaced, interleaved and collated sets of the multipage document are produced.

2. The method of claim 1 wherein the multipage document is of the type having sequentially ordered pages and wherein the first copied page is the last page of the document.

3. The method of claim 1, including the steps of:

restraining a second collated set with respect to a first collated set without restraining the first collated set; and removing the first collated set from the deposit tray.

* * * * *